US006939184B2

(12) United States Patent
Fishburn et al.

(10) Patent No.: US 6,939,184 B2
(45) Date of Patent: Sep. 6, 2005

(54) ISOLATED MOTOR PAN FOR WATERCRAFT

(75) Inventors: Bradley R. Fishburn, Nappanee, IN (US); Jeremiah S. Warfel, Elkhart, IN (US)

(73) Assignee: Bennington Marine, Inc., Elkhart, IN (US)

( * ) Notice: Subject to any disclaimer, the term of this patent is extended or adjusted under 35 U.S.C. 154(b) by 0 days.

(21) Appl. No.: 10/382,447

(22) Filed: Mar. 6, 2003

(65) Prior Publication Data

US 2004/0175996 A1 Sep. 9, 2004

(51) Int. Cl.[7] ..... B63H 1/15
(52) U.S. Cl. ..... 440/52; 114/61.1
(58) Field of Search ..... 114/61.1, 61.15–61.19, 114/61.22, 61.23, 52; 440/52

(56) References Cited

U.S. PATENT DOCUMENTS 3,884,174 A * 5/1975 Larsen ..... 440/52
4,535,717 A 8/1985 Bryan et al.
4,562,786 A * 1/1986 Pruonto ..... 114/61.22
4,978,320 A * 12/1990 Chaplin et al. ..... 440/52
5,259,331 A * 11/1993 Hagan ..... 114/61.1
5,266,856 A 11/1993 Holter
5,846,106 A 12/1998 Kumita
5,873,755 A 2/1999 Takahashi et al.
6,302,042 B1 * 10/2001 Biedenweg et al. ..... 114/61.22
6,475,044 B1 11/2002 Jones

* cited by examiner

*Primary Examiner*—Ed Swinehart
(74) *Attorney, Agent, or Firm*—Baker & Daniels LLP

(57) ABSTRACT

A dampening assembly used in watercraft to isolate the motor from the deck of the watercraft. In an embodiment of the invention, a frame including cross-members and a plurality of brackets supports the deck. The dampening assembly of the present invention extends from the brackets of the frame to the motor and retains the motor at a position ensuring the motor does not contact the frame. The only path available to the vibrations generated by the motor is represented by the dampening assemblies that direct the vibrations to the brackets and tubes, thereby eliminating the high amplitude, low frequency vibrations that readily transfer throughout the deck and frame structure. In this manner, the vibrations are prevented from traveling directly through the cross-members of the frame and into the deck of the watercraft.

14 Claims, 5 Drawing Sheets

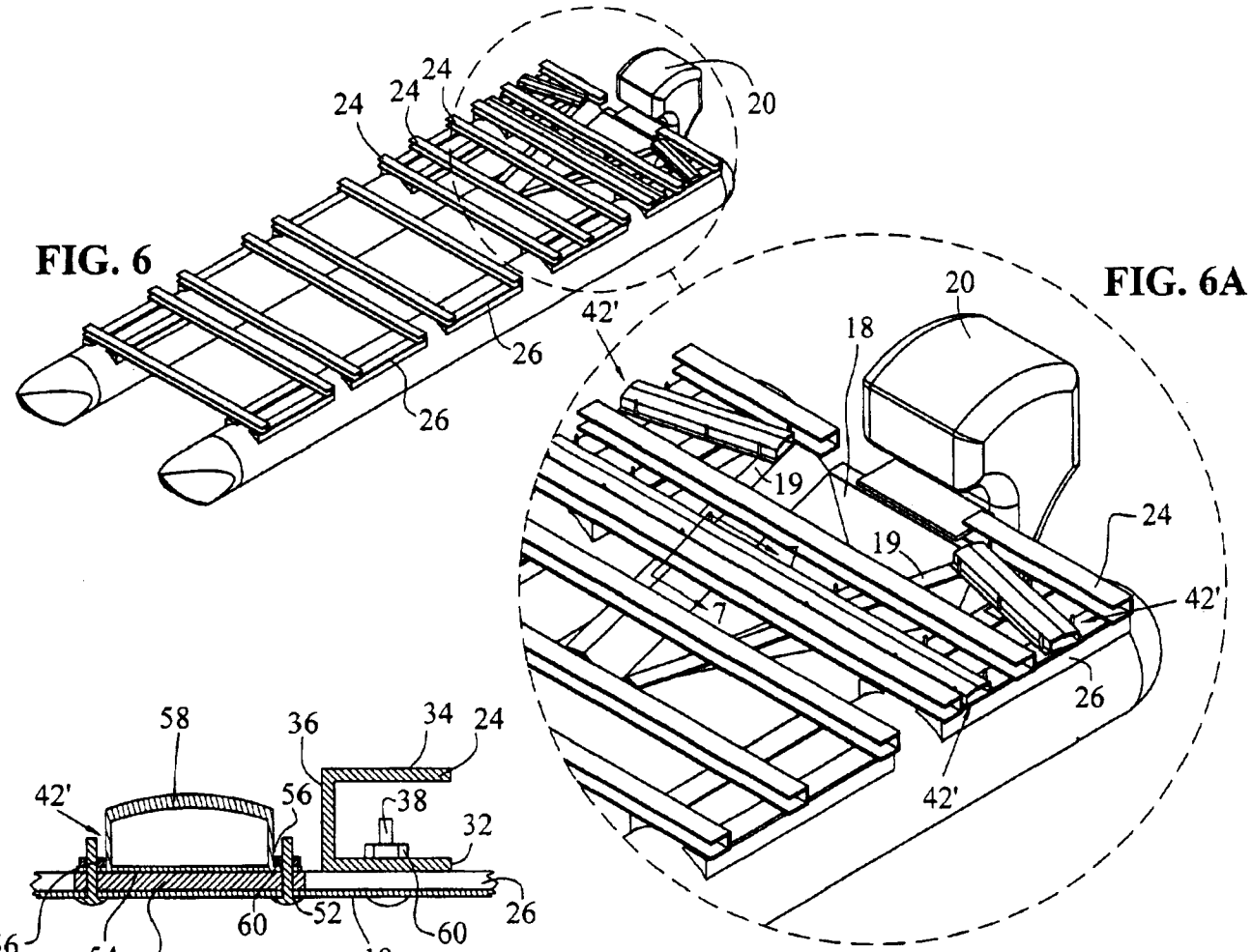
FIG. 6
FIG. 6A
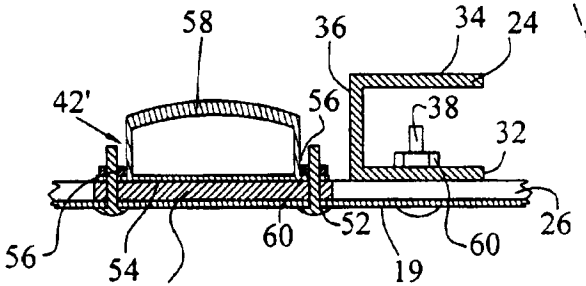
FIG. 7

ISOLATED MOTOR PAN FOR WATERCRAFT

BACKGROUND OF THE INVENTION

1. Field of the Invention

The present invention relates to the reduction of the transfer of vibration in watercraft. Specifically, the present invention relates to the isolation of the motor from the deck of a watercraft.

2. Description of the Prior Art

Generally, in the field of watercraft, the propulsion unit, or motor as it is commonly referred to, is mounted directly to the frame of the watercraft. Standard motor units, notably those of the outboard variety, are commonly known to vibrate, especially at low speeds. Traditionally, the direct mounting of the motor to the frame of the watercraft allows the transfer of vibrations from the motor directly to the deck of the watercraft, thereby creating high levels of vibration in the deck.

High levels of vibration in the deck of a watercraft can be problematic for a variety of reasons. For example, the high vibration levels can reduce the enjoyment of the passengers in the watercraft. Furthermore, high levels of vibration may also loosen fasteners in the watercraft, such as screws or bolts, thereby requiring an operator to perform frequent maintenance in order to ensure that the fasteners remain secure.

SUMMARY OF THE INVENTION

The present invention relates to a watercraft having a frame, a motor, a deck attached to the frame, and a dampening assembly. The dampening assembly joins the motor to the frame while at the same time dampening the vibration energy transferred from the motor to the deck.

In an embodiment of the present invention, the watercraft is a pontoon boat that includes a plurality of pontoons coupled to the frame. In addition, the frame may be comprised of a plurality of cross members joined to, and extending between, a plurality of brackets. In an embodiment of the present invention, the brackets are affixed to the pontoons, while the cross members are affixed to the deck. Consequently, the frame joins the deck of the watercraft to the pontoons. In addition, the watercraft may also include a motor pan to which the motor is mounted. In this embodiment, the dampening assembly may act as a means of attaching the motor pan to the frame, in an effort to reduce the vibrations transferred to the deck.

In an embodiment of the present invention, the dampening assembly includes a first cross member, a second cross member, and a bushing. The first cross member and the bushing are positioned and retained within the second cross member, with the bushing separating the two cross members. Furthermore, in this embodiment, the second cross member is attached to the frame with the entire assembly extending away from the frame to the motor pan. In addition, the second cross member is fastened to the motor pan in a manner ensuring that the motor pan is positioned to prevent contact between the motor pan and the frame. Furthermore, in an embodiment of the present invention, a shim is located between the dampening assembly and the motor pan in order to position the motor pan vertically below both the dampening assembly and the frame.

In an additional embodiment, the dampening assembly may be formed from a metal extrusion. The metal extrusion includes a base, a pair of side walls, and a top portion. The base is generally rectangular shaped with the side walls extending perpendicularly upwards therefrom. Furthermore, the top portion connects the edges of the side walls that are located opposite the base. In addition, in one embodiment, the top portion has a slightly rounded or elliptical shape. In this embodiment of the dampening assembly, the assembly extends from the frame to the motor pan with a shim positioned between the lower surface of the base and the motor pan, in order to position the motor pan at a level below the cross members of the frame. The positioning of the motor pan at this location ensures that the motor pan does not directly contact any of the components comprising the frame.

In the embodiments described above, the dampening assemblies succeed in isolating the motor from the frame. This isolation of the motor limits the travel path the motor vibrations may take. Specifically, the vibrations generated by the motor must travel through the dampening assembly in order to reach the frame, at the point the frame attaches to the pontoons. Consequently, much of the vibration energy is then dissipated through the pontoons and into the water in which the watercraft resides. The energy dissipation through the pontoons reduces the motor generated vibration energy that is transferred into the deck of the watercraft.

Further features of the present invention will become apparent from the detailed description contained herein. However, it should be understood that the detailed description, and specific examples, while indicating embodiments of the invention, are given by way of illustration only, since various changes and modifications within the spirit and scope of the invention will become apparent to those skilled in the art.

DETAILED DESCRIPTION OF THE DRAWINGS

These and other features of the invention will become more apparent and the present invention will be better understood upon consideration of the following description and the accompanying drawings wherein:

FIGS. 6 and 6A depict perspective views at various magnifications of the pontoons, frame, motor, motor pan, and dampening assembly utilized in the watercraft depicted in FIG. 5; and FIG. 7 depicts a section view taken along section line 7—7 of FIG. 6.

DETAILED DESCRIPTION OF EMBODIMENTS OF THE INVENTION

The embodiments of the invention described herein are not intended to be exhaustive, nor to limit the invention to the precise forms disclosed. Rather, the embodiments selected for description have been chosen to enable one skilled in the art to practice the invention.

Figure 1:
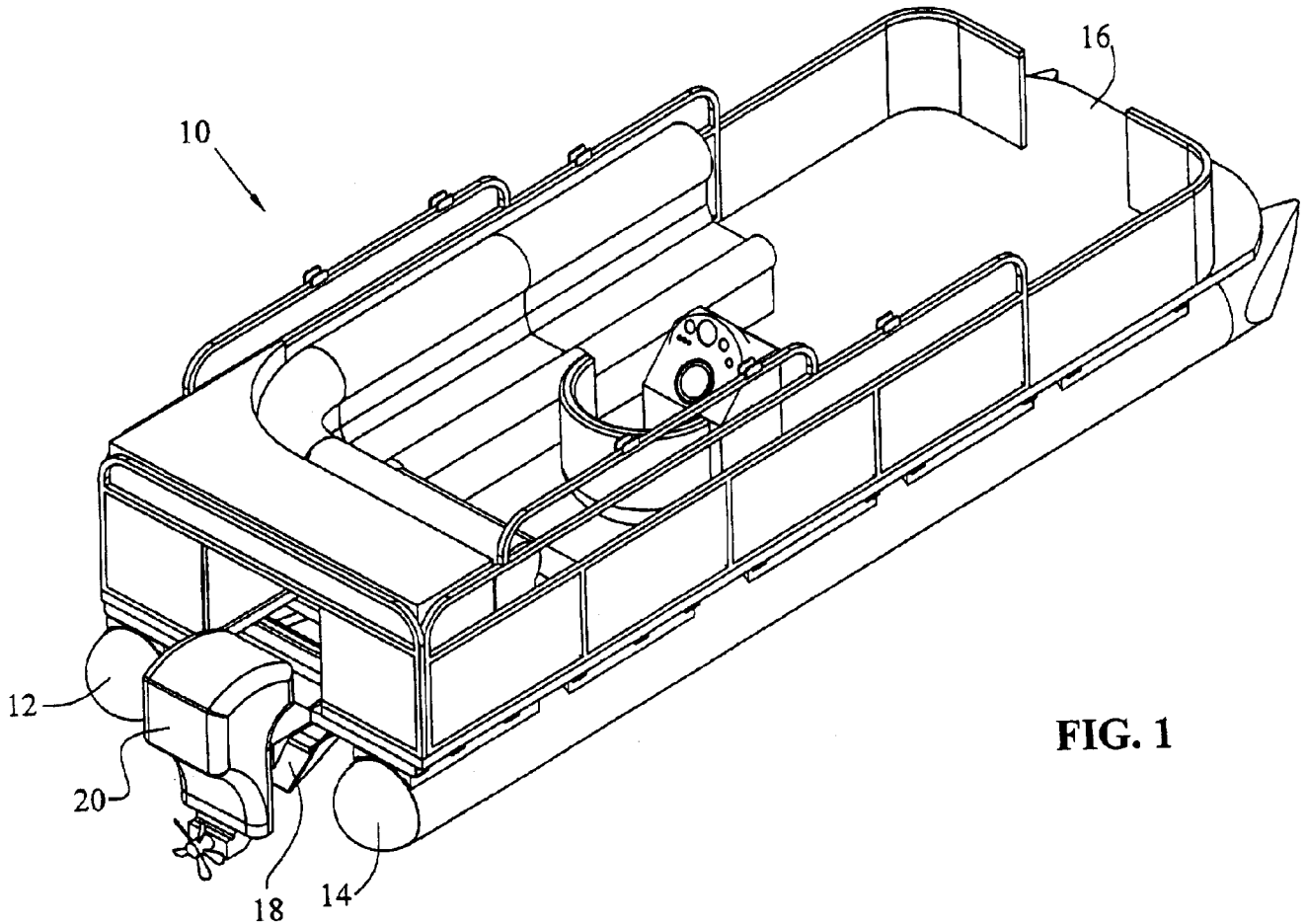
FIG. 1 depicts a perspective view of an embodiment of the present invention employed in a watercraft.

Referring first to FIG. 1, numeral 10 generally indicates a watercraft. Although the type of watercraft that may be used in conjunction with this invention may vary, the watercraft 10 illustrated in FIG. 1 is generally referred to as a pontoon boat. In the embodiment depicted, watercraft 10 includes a first pontoon 12, a second pontoon 14, a deck 16, a motor pan 18 and a motor 20. Although the watercraft 10 includes only two pontoons 12, 14 in the present embodiment, the number of pontoons may be increased as is known in the art without varying from the spirit and scope of this invention. In addition, in other embodiments of the invention, the watercraft 10 may be a different type of watercraft including types that do not employ pontoons.

Referring still to FIG. 1, the motor 20 depicted is of the type generally referred to as an outboard motor. In the embodiment depicted, motor 20 is mounted to motor pan 18 in a well known manner. Typically, the manner of mounting the motor 20 to the motor pan 18 provides support to the motor 20 as the motor 20 propels the watercraft 10. In addition, the motor 20 may also tilt relative to the motor pan 18 in a typical manner. Furthermore, in alternative embodiments of the present invention, other types of motors such as those of the inboard/outboard variety may be employed.

Figures 2, 2A, 2B:
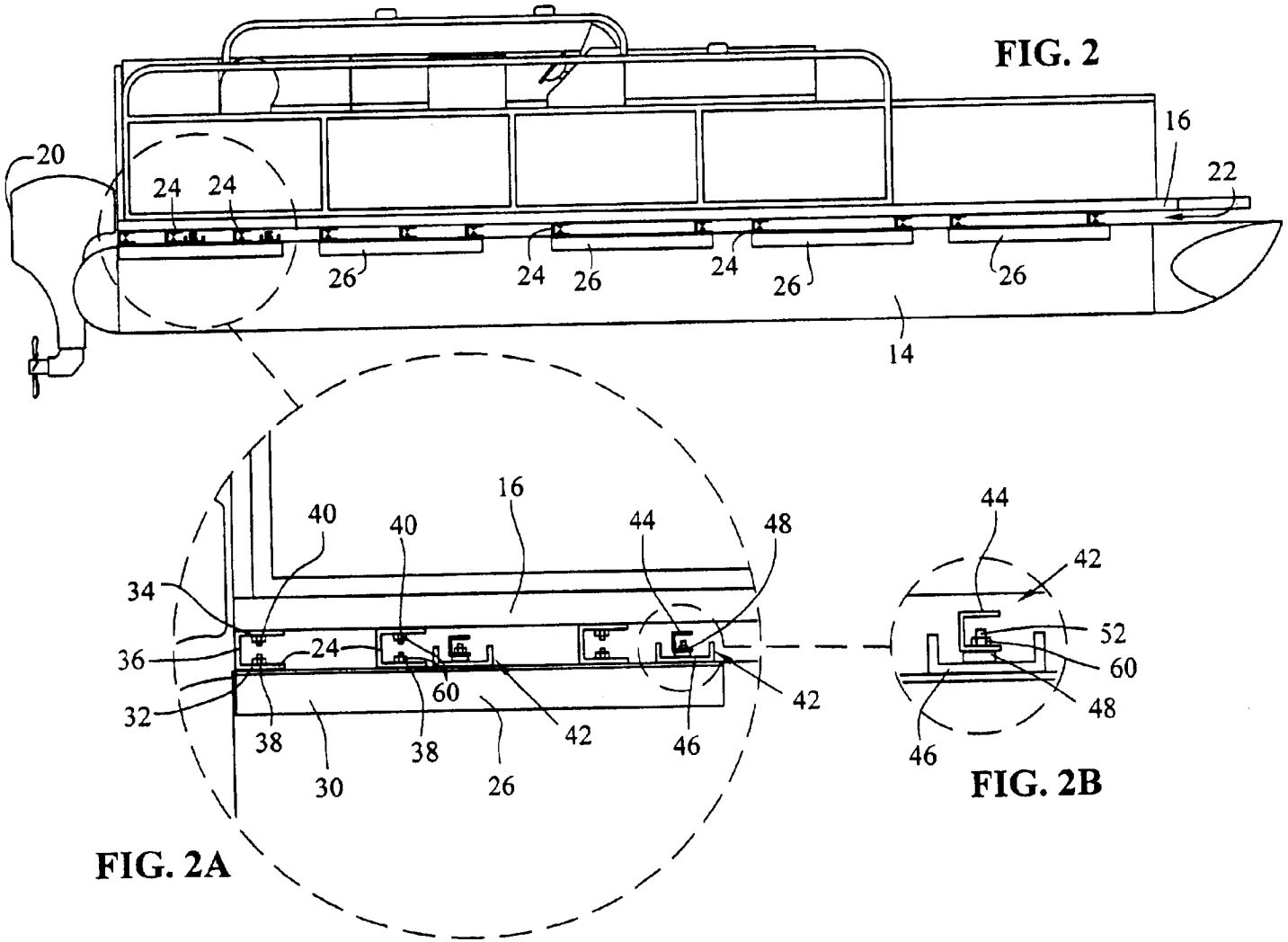
FIGS. 2 through 2B depict side views at various magnifications of the watercraft depicted in FIG. 1.
Figures 3, 3A, 4:
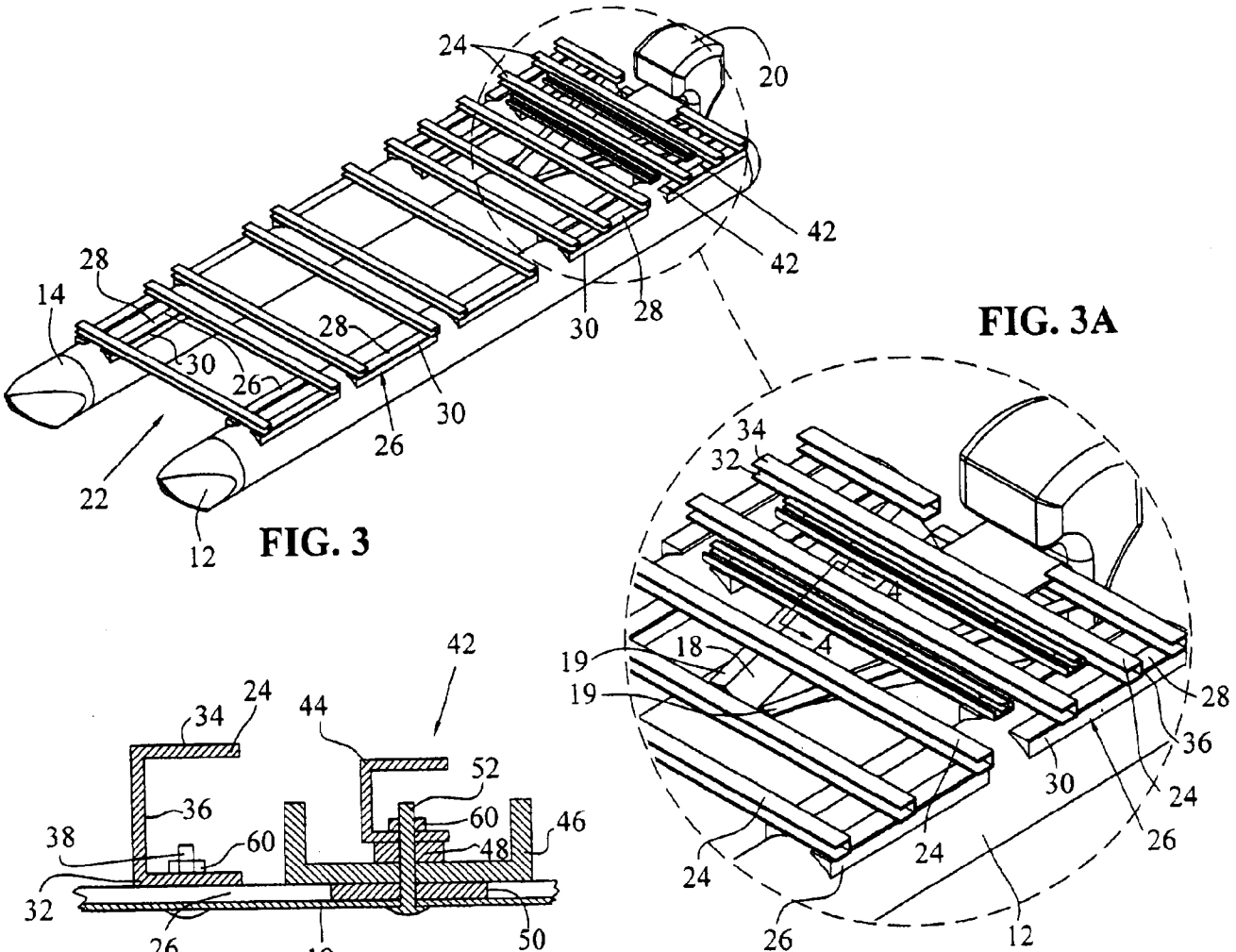
FIGS. 3 and 3A depict perspective views at various magnifications of the pontoons, frame, motor, motor pan, and dampening assembly utilized in the watercraft depicted in FIG. 1.
FIG. 4 depicts a section view taken along section line 4—4 of FIG. 3A.

Referring now to FIGS. 2–4, an embodiment of the watercraft 10 depicted in FIG. 1 is illustrated. It should be noted that FIGS. 3–4 depict the watercraft 10 with all of the components located above the deck 16 (indicated in FIGS. 1 and 2) removed for descriptive purposes. FIGS. 2–4 depict the watercraft 10 as further including a frame 22. In the embodiment depicted, frame 22 includes a plurality of cross-members 24 and a plurality of brackets 26. As depicted, the frame 22 joins the deck 16 to the first and second pontoons 12, 14.

As can be seen specifically in FIGS. 3 and 3A, each of the brackets 26 included in the frame 22 has a horizontal plate 28 and a vertical plate 30, disposed perpendicular to each other. Additionally, in the embodiment depicted, all of the horizontal plates 28 of the brackets 26 are located in the same horizontal plane. Vertical plates 30, however, are disposed in a variety of vertical planes depending upon the attachment portion of the brackets 26 to the pontoons 12, 14. As is depicted in FIG. 3, a plurality of brackets 26 extend along the outer portion of each of the pontoons 12, 14, while an additional group of brackets 26 are located along the inner portions of the pontoons 12, 14. The number of brackets 26 attached to the pontoons 12, 14 may be altered as needed in order to ensure adequate support is provided to deck 16. In addition, the brackets 26 may be attached to the pontoons 12, 14 in any manner well known in the art. For example, in the embodiment depicted, the brackets 26 are welded to the pontoons 12, 14. However, the method of attachment may be altered to conform to any method well known in the art. In addition, the configuration of the brackets 26 may be altered to conform to any configuration well known in the art.

Referring now specifically to FIGS. 2 and 2A, it can be seen that the rearmost cross-member 24 need not extend completely across the width of watercraft 10. As is depicted, shorter cross-members 24 may be employed in frame 22 near the rear of the craft 10. The inclusion of shorter cross-members 24 may be necessary in order to allow motor 20 to tilt upwards without contacting frame 22 ensuring the motor 20 remains isolated from frame 22.

Referring still to FIGS. 2–4, the cross-members 24 are illustrated as being attached to the brackets 26. In the embodiment depicted, each of the cross-members 24 has a length approximately equal to the distance separating the outer edges of brackets 26 that are located on the outer portions of the pontoons 12, 14, such that the cross-members 24 span the brackets 26. As can be seen in FIGS. 2 and 2A, each of the cross-members 24 includes a lower plate 32, an upper plate 34 and a vertical plate 36. Lower plate 32 and upper plate 34 extend parallel to each other with vertical plate 36 located therebetween. This configuration forms a known C-channel type design. However, in alternative embodiments, cross-members 24 having alternative configurations may be employed. In addition, the cross-members 24 depicted in this embodiment may be formed from stainless steel, aluminum, or other similar material well known in the industry.

Referring now to FIG. 2A, the watercraft 10 is illustrated as further including a plurality of fasteners 38. Fasteners 38 may be manufactured from any material well known in the art having high strength and high resistance to rust and corrosion. Fasteners 38 are dispersed throughout frame 22 and generally extend through both the lower plate 32 of the cross-members 24 and the horizontal plate 28 of the brackets 26. In this manner, the fasteners 38 succeed in attaching the cross-members 24 to the brackets 26. Furthermore, as can be seen in FIGS. 2 and 2A, watercraft 10 further includes a plurality of fasteners 40 extending through both the deck 16 and the upper plates 34 of the cross-members 24. This allows deck 16 to be secured to the frame 24 in a well known manner. In order to accomplish this, the fastener 40 may be of any type utilized in the art, such as bolts or screws, and preferably fasteners known as carriage bolts. In addition, the fasteners 40 are generally manufactured from a material that does not corrode or rust when in contact with water, thereby extending the life and durability of the fasteners 40. It should be noted that in the embodiment depicted both sets of fasteners 38, 40 extend into nuts 60 in a well known manner in order to secure the fasteners in position.

Now that the general superstructure of watercraft 10 has been described, one of the embodiments of the means for attaching the motor pan 18 to the frame 22 will be described in detail. Specifically, FIGS. 2–4 depict a plurality of dampening assemblies 42. In this embodiment, each dampening assembly 42 includes a first cross-member 44, a second cross-member 46 and a bushing 48. The first cross-member 44 is illustrated as having a structure identical to the cross-members 24. However, in this embodiment, the size of the cross-members 24, 44 differ. In a manner similar to the cross-members 24, the first cross-member 44 may be extruded from stainless steel or aluminum as required. As can be seen in FIG. 3, both the first cross-member 44 and the dampening assembly 42 overall has a length approximately equal to the distance separating the brackets 26 of the frame 22 located on the inner portions of the pontoons 12, 14. In addition, a plurality of apertures is disposed through the lower surface of the first cross-members 44.

The second cross-member 46 of the dampening assembly 42 consists of a similar C-shaped design seen in the cross-members 24 of the frame 22 and the first cross-members 44 of the dampening assemblies 42. However, the second cross-member 46 is shown as being rotated 90° along its longitudinal axis from the position first cross-member 44 is located orientating the opening of the C-channel upwards. In some embodiments, the second cross-member 46 may be extruded from the same mold as the cross-members 24 and merely rotated 90° in order to perform the function as described herein.

Referring now specifically to FIGS. 2B and 4, a bushing 48 is depicted as separating first cross-member 44 and second cross-member 46. The bushing 48 may be manufactured from any material well known for dampening or absorbing vibration. For example, in the embodiment depicted, a bushing 48 is comprised of a rubber material. Furthermore, it should be noted that the distance from the top surface of first cross-member 44 to the bottom surface of second cross-member 46 is controlled by the height of bushing 48. In the embodiment depicted, this distance is less than the overall height of the cross-members 24 comprising the frame 22.

Now that the structure of the dampening assembly 42 has been set forth above, the manner in which the dampening assembly 42 attaches the motor pan 18 to the frame 22 will be described in detail. Referring first to FIGS. 2–3, it can be seen that the dampening assembly 42 may be attached to the inner brackets 26 of the frame 22 by way of a fastener 52. Fastener 52 may be of a similar type to that of fasteners 38 and 40 and may be comprised of a material similar to that of the fasteners 38, 40. Specifically, the fastener 52 should be manufactured from a material having high strength and rigidity but also very resistant to rust and corrosion, especially when in contact with water. The fastener 52 succeeds in attaching the dampening assembly 42 to the brackets 26 by extending through apertures (not shown) located within first cross-member 44, second cross-member 46, and bushing 48 in addition to an aperture (not shown) located within the bracket 26. Furthermore, it should be noted that fastener 53 extends through a nut 60 similar to that described above with regards to fasteners 38, 40.

Referring now specifically to FIGS. 3 and 4, the attachment of the motor pan 18 to the dampening assembly 42 is illustrated. As can be seen in both figures, a shim 50 extends along the bottom surface of the dampening assembly 42 in order to separate the mounting surface 19 of motor pan 18 from the lower surface of the dampening assembly 42. Shim 50 may be manufactured from any lightweight material known for resisting corrosion, such as aluminum. In addition, shim 50 generally includes a plurality of apertures (not shown) that extend completely therethrough.

The attachment of the dampening assembly 42 to the motor pan 18 is achieved by way of the extension of additional fasteners 52 through the first cross-member 44, the second cross-member 46, the bushing 48, the shim 50 and the mounting surface 19 of the motor pan 18. A nut 60 is then employed to secure the fastener 52 in a manner well known. The presence of the shim 50 between the bottom surface of the second cross-member 46 and the mounting surface 19 of the motor pan 18 spaces the motor pan 18 in a plane below the horizontal plane that includes the horizontal plates 28 of the brackets 26. Consequently, as should be appreciated, the motor pan 18 is disposed at a level below the lower surface of the cross-members 24 so that cross-members 24 do not contact the motor pan 18. In addition, as should be apparent, the distance separating the cross-members 24 from the motor pan 18 is determined by the height of the shim 50.

In some embodiments, the rearmost cross-members 24 may also be attached to motor pan 18 in a manner similar to that in which the dampening assemblies 42 are attached to the motor pan 18. The attachment of the rearmost cross-members 24 to the pan 18 provides additional support to motor pan 18. In embodiments with the members 24 attached to the pan 18, a shim (not shown) with a height identical to that of shim 50 must be included between the lower surface of lower plate 32 and the mounting surface 19 of the motor pan 18. This ensures that the frame 22 remains separated from the motor pan 18. Once the shim has been positioned between the cross-member 24 and the mounting surface 19, a fastener (not shown), similar to fastener 52 discussed above, may be inserted through the lower plate 32, the shim and the mounting surface 19. The fastener is then affixed in a known manner; to secure the three previously mentioned components together. For example, in one embodiment, a nut 60 is affixed to the end of the fastener, retaining the components to one another. It should be appreciated, however, that alternative methods of attaching cross-member 24 to the motor pan 18 may be utilized as desired.

Figure 5:
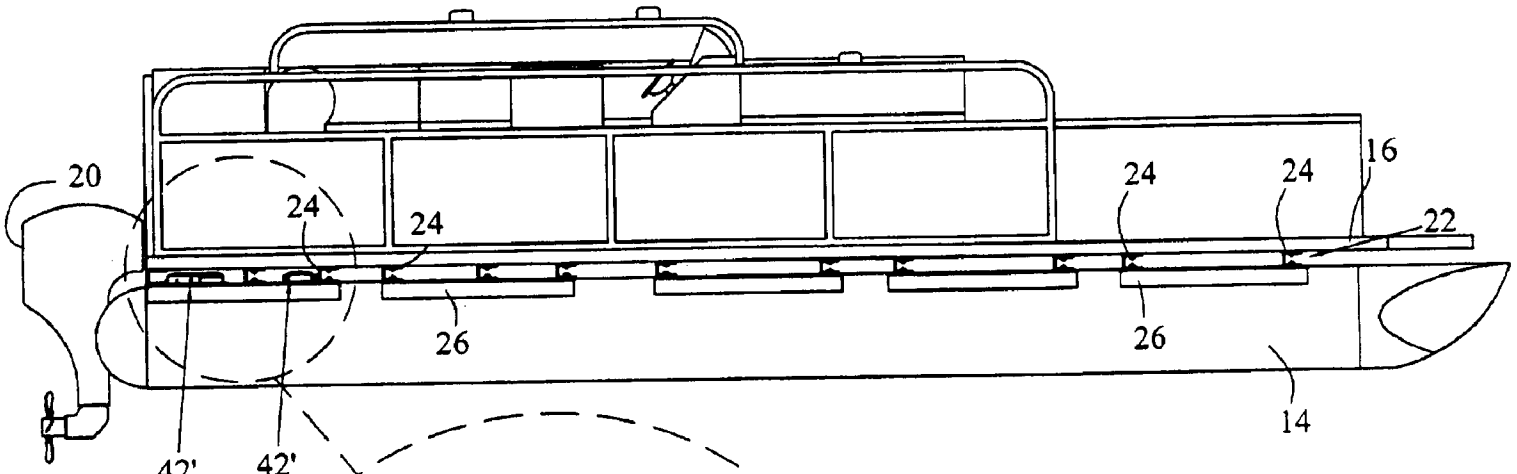
FIGS. 5 and 5A depict side views at various magnifications of the watercraft illustrated in FIG. 1 employing an alternative embodiment of the dampening assembly.
Figure 5A:
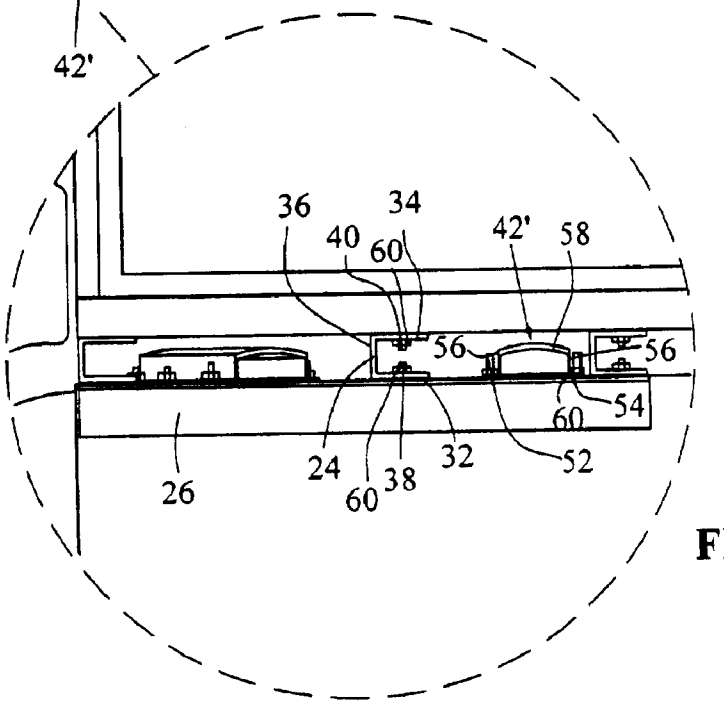

Referring now to FIGS. 5–7, an alternative embodiment of the dampening assembly 42 is depicted with the remaining components of watercraft 10 remaining identical to that described above. This alternative embodiment is generally indicated by numeral 42'. As can be seen, dampening assembly 42' includes a one-piece extrusion having a base 54, a pair of walls 56 and a top portion 58. In this embodiment, dampening assembly 42' is depicted as being formed from a single extrusion of a material having high rigidity, high beam strength, and high resistance to rust and corrosion when in contact with water. It should be noted that in alternative embodiments, however, the dampening assembly 42' need not be extruded as one solid component. Rather, dampening assembly 42' may be comprised of separate components affixed to one another in a well known manner. Furthermore, it should be noted that in the embodiment depicted, the dampening assembly 42' has a length allowing for the extension of the dampening assembly 42' between the outer brackets 26 included in the frame 22. The length of the damping assembly 42', however, may be shortened so that damping assembly 42' extends between the inner brackets 26 of frame 22. Furthermore, the rearmost dampening assembly 42' need not extend across the watercraft 10, but rather may have a length allowing the assembly 42' to extend to just the motor pan 18.

As stated above, the dampening assembly 42' illustrated in FIGS. 5–7 includes base 54, a pair of walls 56 and top portion 58. In the embodiment depicted, base 54 represents the flat, planar, rectangularly shaped lower portion of the dampening assembly 42'. Walls 56 rise perpendicularly upward from base 54 extending longitudinally parallel to the long edges of the rectangularly shaped base 54. In the embodiment depicted, the walls 56 each extend a distance upwards from the base 54 that is less than the distance vertical plate 36 extends upwards from lower plate 32 in the cross-members 24 of frame 22. Dampening assembly 42' also includes top portion 58, a slightly curved horizontal piece. In alternative embodiments, the shape and curvature of the top portion 58 may be altered as desired. However, when altering the shape of the top portion 58, one must ensure that the overall height of the dampening assembly 42' does not become greater than the height of the cross-members 24.

Dampening assemblies 42' may attach the motor pan 18 to the frame 22 in a variety of ways. For example, with reference to FIG. 6A, it can be seen that in the embodiment illustrated the rearward dampening assemblies 42' are arranged in such a way that the dampening assemblies 42' extend perpendicularly from the mounting surfaces 19 of motor pan 18. In alternative embodiments, however, the rear dampening assemblies 42' may be arranged such that each dampening assembly 42' extends parallel to the cross-members 24 of the frame 22. In either embodiment, regardless of the direction of extension of the rear dampening assemblies 42', the dampening assemblies 42' are affixed to both the frame 22 and the motor pan 18 in a similar manner.

The dampening assemblies 42' are joined to frame 22 at the brackets 26. Specifically, the dampening assemblies 42' are positioned atop the brackets 26 with base 54 resting upon the horizontal plates 28 of the brackets 26. The dampening assemblies 42' are then affixed to bracket 26 by way of fasteners 52 extending through both the horizontal plate 28 and the base 54. The fastener 52 may be affixed to the horizontal plate 28 and the base 54 by way of a nut 60 in a well known manner. Furthermore, as should be appreciated, the top portion 58 may limit the ease in which the nuts 60 may fasten to the fasteners 52. Therefore, if desired, the fasteners 52 may be inserted through the base 54 outside of the walls 56, in this embodiment.

The dampening assembly 42' is joined to the motor pan 18 in a similar manner. Referring specifically to FIG. 7, it can be seen that fasteners 52 extend through both the base 54 of the dampening assembly 42' and the horizontal mounting surface 19 of the motor pan 18 in joining the dampening assembly 42' to the motor pan 18. However, as can be viewed in FIG. 7, shim 50 is located between the base 54 and the mounting surface 19. As should be apparent, the inclusion of the shim 50 disposes the motor pan 18 at a height below that of the lower plates 32 of the cross-members 24. Consequently, the cross-members 24 of frame 22 do not contact the motor pan 18.

Now that the attachment of the motor pan 18 to the frame 22 by way of the dampening assemblies 42' have been described, the next step in assembling watercraft 10 requires the attachment of deck 16 to the frame 22. Deck 16 may be manufactured from any material commonly utilized in the art, such as plywood or aluminum. The deck 16 is placed across the top surface of the upper plates 34 of the cross-members 24 and affixed thereto by way of fasteners 38 as is shown in FIGS. 2, 2A, 5 and 5A. Fastener 38 may be of any type well known capable of affixing the deck 16 to the cross-members 24 by way of insertion through both the deck 16 and the cross-members 24 in a well known manner. In addition, fasteners 38 may even be identical to fasteners 40, if desired. Furthermore, it should be noted that in both of the embodiments depicted herein the dampening assembly 42, 42' has a height less than that of the cross-members 24. This ensures that the dampening assemblies 42, 42' do not contact the deck 16 following the attachment of the deck 16 onto the cross-members 24. Once the deck 16 has been attached to frame 22, additional components, such as seats, tables, side rails, etc. may be installed upon deck 16 in the traditional manner in order to complete the assembly of watercraft 10.

The above-described assembly has the effect of isolating the motor pan 18 from the frame 22 of the watercraft 10. Furthermore, as the frame 22 supports deck 16 of the watercraft 10, the above-described assembly also isolates the motor pan 18 from the deck 16. This isolation reduces the transfer of motor vibration from motor 20 to deck 16 and further, reducing motor vibration experienced by the occupants of the watercraft 10 in the manner described immediately following.

As should be appreciated, motor vibration generated by the operation of the motor 20 is transferred through motor pan 18 into the dampening assembly 42. The vibrational energy is then transferred into the pontoons 12, 14 before being transferred to the cross-members 24 of the frame 22. This is accomplished by having a set of cross-braces 24 for attachment of the deck 16 to the pontoons 12, 14 and a set of dampening assemblies 42, 42' for attachment of the motor pan 18 to the pontoons 12, 14. As the pontoons 12, 14 reside within water during the operation of motor 20; the vibrational energy is partially absorbed by and transferred into the water. This transfer of vibrational energy into the water reduces the magnitude of the vibrational energy transferred into the cross-members 24 of the frame 22. Consequently, the vibrational energy transferred into deck 16 by way of the cross-members 24 is minimal. This reduction in vibrational energy transferred is appreciated when considered with respect to the prior art watercraft, which generally mount the motor directly to the frame, thereby allowing for the direct transfer of the vibrational energy from the motor to the deck. Consequently, the dampening effect of the present invention results in significantly less vibrational energy being transferred into the deck 16 of the watercraft 10 and, therefore, allows occupants of the watercraft 10 to enjoy a smoother ride with less vibration being felt by the occupants of the watercraft 10.

While this invention has been described as having an exemplary design, the present invention may be further modified within the spirit and scope of this disclosure. The application is, therefore, intended to cover any variations, uses, or adaptations of the invention using its general principles. Further, this application is intended to cover such departures from the present disclosure as come within known or customary practice in the art to which this invention pertains.

What we claim is:

1. A watercraft comprising:

a plurality of pontoons;

a frame including a plurality of cross members and a plurality of brackets, said brackets being affixed to said pontoons and said cross members being affixed to said brackets and extending between said pontoons;

a deck positioned on top of said frame;

a motor mounting assembly, isolated from said frame, and attached to said pontoons;

a motor attached to said motor mounting assembly.

2. The watercraft as set forth in claim 1, wherein said motor mounting assembly is affixed to said brackets of said frame.

3. The watercraft as set forth in claim 1, wherein said deck is attached to said frame opposite said pontoons.

4. The watercraft as set forth in claim 3, wherein said deck is attached to said cross members of said frame.

5. The watercraft of claim 2, wherein said motor mounting assembly is comprised of a cross beam assembly attached to said brackets, and a motor pan connected to said cross beam assembly.

6. The watercraft as set forth in claim 5, wherein said motor mounting assembly further includes a shim disposed between said motor pan and said cross beam assembly.

7. The watercraft as set forth in claim 5, wherein said cross beam assembly includes a first cross member, a second cross member, and a bushing, said first cross member and said bushing disposed within said second cross member.

8. The watercraft as set forth in claim 7, wherein said bushing is comprised of rubber.

9. The watercraft as set forth in claim 5, wherein said cross beam assembly is comprised of a metal extrusion.

10. The watercraft as set forth in claim 9, wherein said metal extrusion includes a base, a pair of walls, and a top portion, said base separated to said motor pan by way of said shim.

11. The watercraft as set forth in claim 5, wherein said cross beam assembly is located above said motor pan and is spaced apart from said motor pan.

12. The watercraft as set forth in claim 1, wherein any vibration energy crated through operation of said motor is transferred by said motor mounting assembly into said pontoons and dampened by water supporting said pontoons.

13. The watercraft as set forth in claim 1, wherein said motor mounting assembly is positioned in a plane below said frame cross members.

14. The watercraft as set forth in claim 13, wherein said motor mounting assembly includes a plurality of beams spanning across and fixed to said brackets, wherein a vertical height of said beams is less than a vertical height of said frame cross members.

* * * * *